US011101127B2

(12) United States Patent
Mizutani

(10) Patent No.: US 11,101,127 B2
(45) Date of Patent: Aug. 24, 2021

(54) TIME-OF-FLIGHT MASS SPECTROMETER

(71) Applicant: SHIMADZU CORPORATION, Kyoto (JP)

(72) Inventor: Shiro Mizutani, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 16/755,729

(22) PCT Filed: Nov. 2, 2017

(86) PCT No.: PCT/JP2017/039691
§ 371 (c)(1),
(2) Date: Apr. 13, 2020

(87) PCT Pub. No.: WO2019/087347
PCT Pub. Date: May 9, 2019

(65) Prior Publication Data
US 2021/0202229 A1 Jul. 1, 2021

(51) Int. Cl.
*H01J 49/40* (2006.01)
*H01J 49/02* (2006.01)

(52) U.S. Cl.
CPC ..... *H01J 49/401* (2013.01); *H01J 49/022* (2013.01)

(58) Field of Classification Search
CPC ..... H01J 49/02; H01J 49/022; H01J 49/40; H01J 49/401; H01J 49/403
See application file for complete search history.

(56) References Cited

U.S. PATENT DOCUMENTS

| | | | | |
|---|---|---|---|---|
| 4,511,815 | A | 4/1985 | Wood | |
| 9,870,910 | B2 * | 1/2018 | Haufler | H01J 49/0095 |
| 2013/0214148 | A1 * | 8/2013 | Albeanu | H01J 49/401 250/282 |
| 2019/0006168 | A1 | 1/2019 | Mizutani | |

FOREIGN PATENT DOCUMENTS

| | | | |
|---|---|---|---|
| JP | 5-304451 | A | 11/1993 |
| JP | 2000-134075 | A | 5/2000 |
| JP | 2001-283767 | A | 10/2001 |
| WO | 2017/122276 | A1 | 7/2017 |

OTHER PUBLICATIONS

International Search Report for PCT/JP2017/039691 dated Feb. 6, 2018 [PCT/ISA/210].
Written Opinion for PCT/JP2017/039691 dated Feb. 6, 2018 [PCT/ISA/237].

* cited by examiner

*Primary Examiner* — David E Smith
(74) *Attorney, Agent, or Firm* — Sughrue Mion, PLLC

(57) ABSTRACT

An acceleration voltage generator (7) generates a high-voltage pulse to be applied to an electrode in an orthogonal accelerator by turning on/off a high DC voltage generated by a high-voltage power source through MOSFETs (741) in a switch circuit (74). A controller (6) sends driving pulse signals to the switch circuit (74) through a primary-side driver section (71), transformer (72) and secondary driver section (73). An adjustment circuit (742) formed by a gate resistor (742*a*) and gate capacitor (742*b*) is provided between the secondary-side driver section (73) and the MOSFET (741). The resistance value of the resistor (742*a*) and the capacitance value of the capacitor (742*b*) are determined so as to suppress an overshoot of the gate voltage due to the resonance while preventing a decrease in steepness of the waveform in its rising and falling phases.

7 Claims, 12 Drawing Sheets

Fig. 1
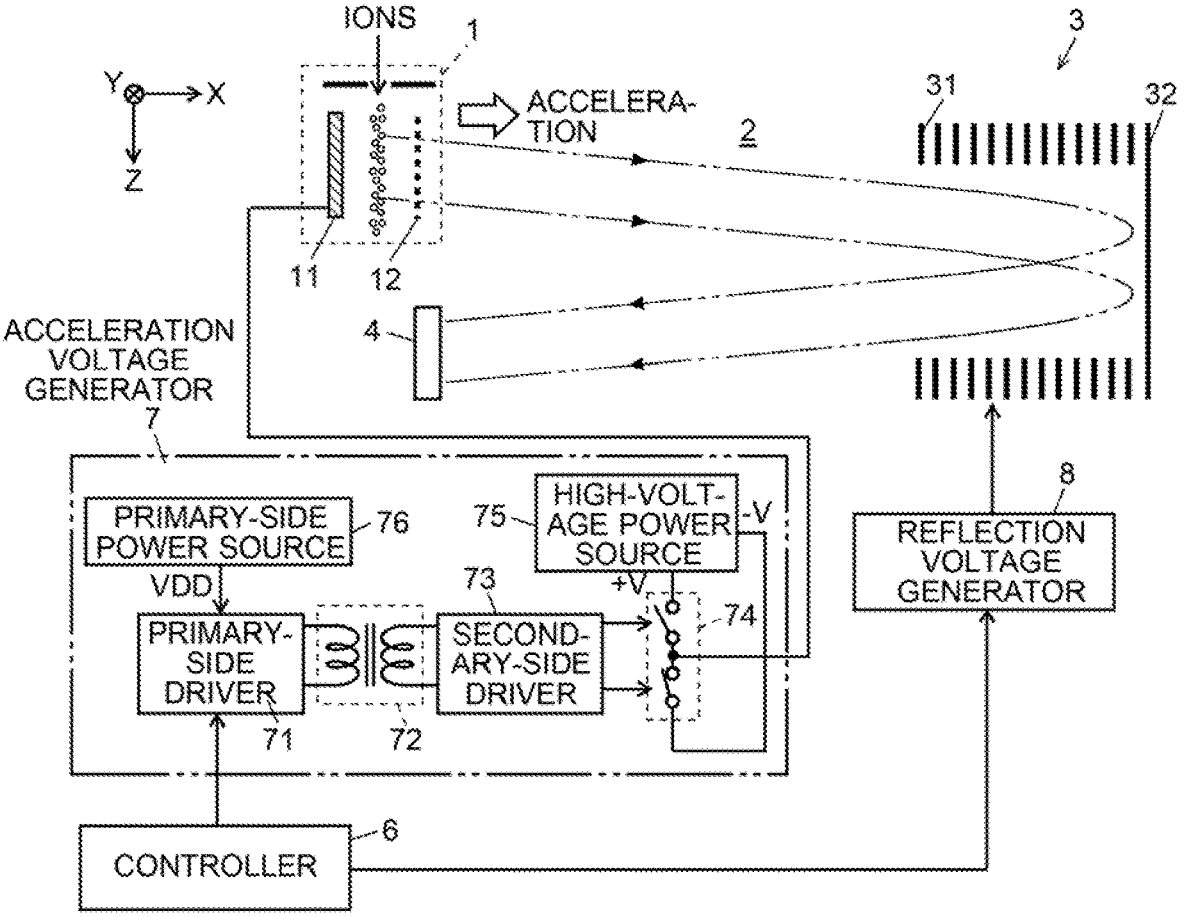
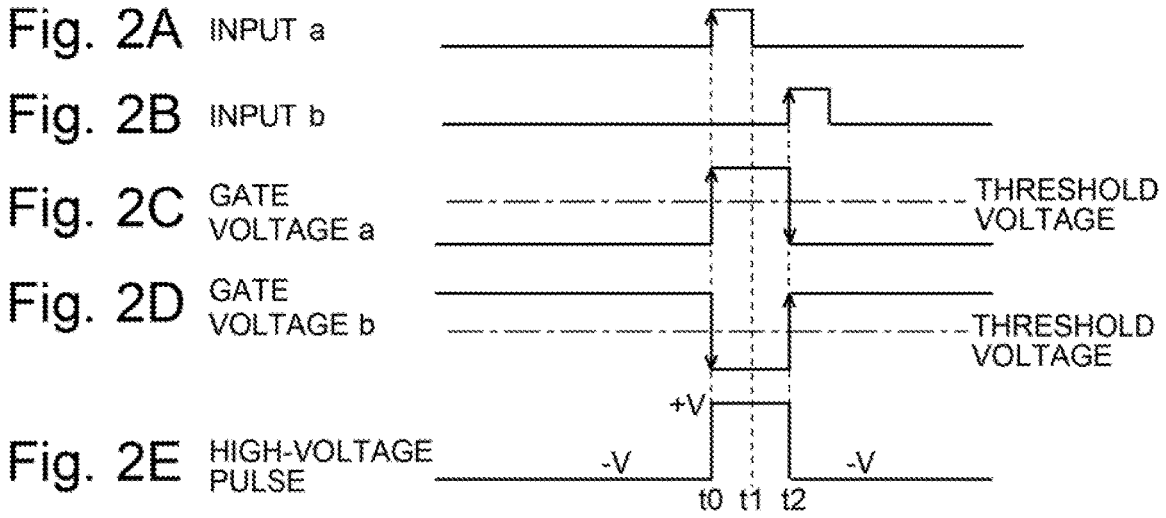

Rg = 3.3Ω

Rg = 10Ω

TIME-OF-FLIGHT MASS SPECTROMETER

CROSS REFERENCE TO RELATED APPLICATIONS

This application is a National Stage of International Application No. PCT/JP2017/039691 filed Nov. 2, 2017.

TECHNICAL FIELD

The present invention relates to a time-of-flight mass spectrometer, and more specifically, to a time-of-flight mass spectrometer configured to repeatedly and periodically perform a measurement operation which includes ejecting ions from an ion ejector and detecting the ions after making them fly in a flight space.

BACKGROUND ART

In a time-of-flight mass spectrometer (which is hereinafter appropriately called the "TOFMS"), various ions originating from a sample are ejected from an ion ejector, and the time of flight required for each of those ions to fly a specific distance is measured. Since the speed of a flying ion depends on the mass-to-charge ratio m/z of the ion, the time of flight also depends on the mass-to-charge ratio of the ion. Accordingly, the mass-to-charge ratio can be determined from the time of flight.

FIG. 12 is a schematic configuration diagram of a commonly used orthogonal acceleration TOFMS (which is hereinafter appropriately called the "OA-TOFMS").

In FIG. 12, ions generated from a sample by an ion source (not shown) are introduced into an ion ejector 1 in the Z-axis direction, as shown by the arrow in the figure. The ion ejector 1 includes a plate-shaped push-out electrode 11 and grid-shaped extraction electrode 12 facing each other. Based on a control signal from a controller 6, an acceleration voltage generator 7 applies a predetermined high-voltage pulse to the push-out electrode 11 or extraction electrode 12 at a predetermined timing, or predetermined high-voltage pulses to the two electrodes, respectively. Ions passing through the space between the push-out electrode 11 and extraction electrode 12 are thereby given acceleration energy in the X-axis direction, which is orthogonal to the Z axis, to be ejected from the ion ejector 1 into a flight space 2. After flying in the field-free flight space 2, the ions enter a reflector 3.

The reflector 3 includes a plurality of ring-shaped reflection electrodes 31 and a back plate 32. Predetermined DC voltages are applied from a reflection voltage generator 8 to the reflection electrodes 31 and back plate 32, respectively. Those voltages create a reflecting electric field within the space surrounded by the reflection electrodes 31. The ions are reflected by this electric field and once more fly in the flight space 2 to ultimately reach a detector 4. The detector 4 generates an ion intensity signal corresponding to the amount of ions which have reached the detector 4, and sends the signal to a data processor 5. The data processor 5 creates a time-of-flight spectrum showing the relationship between the time of flight and ion intensity signal, with the point of ejection of the ions from the ion ejector 1 defined as a time-of-flight value of zero, and calculates a mass spectrum by converting the time of flight into mass-to-charge ratio based on previously determined mass calibration information.

In such an OA-TOFMS, it is necessary to apply a high-voltage pulse having a considerably short duration and a magnitude of kV order to the push-out electrode 11 and/or extraction electrode 12 in the ion ejector 1 when ejecting the ions. In order to generate such a high-voltage pulse, a power unit as disclosed in Patent Literature 1 (which is called the "pulsar power source" in the same literature) has conventionally been used.

This power unit includes the following components: a pulse generator configured to generate a pulse signal for controlling the timing of the generation of the high-voltage pulse; a pulse transformer configured to transmit the pulse signal from a control system circuit to a power system circuit while providing electrical insulation between the control system circuit which operates at a low voltage and the power system circuit which operates at a high voltage; a drive circuit connected to the secondary winding of the pulse transformer; a high-voltage circuit configured to generate a high DC voltage; and a switching element employing a MOSFET configured to generate voltage pulses by turning on/off the DC voltage from the high voltage circuit according to a control voltage given through the drive circuit. Such a circuit is commonly used for generating high-voltage pulses and not limited to the TOFMS (see Patent Literature 2, 3 or other related documents).

In the case of an LC-TOFMS which includes a liquid chromatograph (LC) located in front of an OA-TOFMS having an atmospheric pressure ion source, such as an electrospray ion source, it is necessary to detect all kinds of compounds contained in a sample liquid which is continuously introduced from the exit port of the LC column into the atmospheric pressure ion source of the OA-TOFMS. To this end, the previously described measurement operation for creating a mass spectrum is repeatedly performed with a predetermined period in the OA-TOFMS. The shorter the measurement repetition period is, the shorter the time intervals of the measurement points on the created chromatogram become, which improves the accuracy of the peak waveform of the target compound and increases the reliability of the quantitative determination. Accordingly, in order to achieve the shortest possible time intervals of the measurement points on the chromatogram, a conventional control method is configured so that a relatively short measurement period is set for the measurement of the ions included within a low mass-to-charge-ratio range which corresponds to relatively short times of flight, while a relatively long measurement period is set for the measurement of the ions included within a high mass-to-charge-ratio range which corresponds to relatively long times of flight.

Specifically, in a conventional device of this type, a switching control is performed in which, for example, the measurement period is set at 125 μs for a low mass-to-charge-ratio range of m/z 2000 or lower, 250 μs for a medium mass-to-charge-ratio range of m/z 2000-10000, or 500 μs for a high mass-to-charge-ratio range of m/z 10000-40000.

The switching of the measurement period is performed by changing the time interval of the generation of the high-voltage pulse applied to the push-out electrode 11 and extraction electrode 12 in the ion ejector 1. That is to say, when the measurement period is changed, the parameters other than the time interval of the generation of the high-voltage pulse, such as the pulse duration (pulse application time), are fixed regardless of the measurement period. In the aforementioned power unit for the high-voltage pulse generation, a small amount of temporal delay inevitably occurs between the point in time where the pulse signal inputted to the pulse transformer begins to rise and the point in time of the start of the output of the high-voltage pulse from the power unit. In principle, this temporal delay should be constant and unaffected by the measurement period as long as the voltage value of the high-voltage pulse (pulse peak value) is the same. However, as described in Patent Literature 4, changing the measurement period in a conventional OA-TOFMS causes a temporal fluctuation of the start of the output of the high-voltage pulse from the power unit. It should be noted that the "start of the output of the high-voltage pulse" means a change in voltage which triggers the ejection of the ions in the ion ejector 1, as will be described later.

In TOFMSs, the time of flight of each ion is measured from the point in time of the ejection or acceleration of the ions. Therefore, in order to improve the accuracy of the measurement of the mass-to-charge ratio, the point in time of the beginning of the time-of-flight measurement must be maximally coincide with the timing at which the high-voltage pulse for ion ejection is actually applied to the push-out electrode 11 or the like. If a temporal fluctuation of the start of the output of the high-voltage pulse occurs depending on the measurement period as described earlier, a variation in time of flight occurs by an amount corresponding to the temporal discrepancy between the point in time of the beginning of the measurement and the point in time of the ejection of the ions caused by the temporal fluctuation, so that a mass discrepancy occurs even when the mass-to-charge ratio of the ion is the same. Consequently, a change in measurement period leads to a decrease in mass accuracy.

CITATION LIST

Patent Literature

Patent Literature 1: JP 2001-283767 A
Patent Literature 2: JP H05-304451 A
Patent Literature 3: U.S. Pat. No. 4,511,815 B
Patent Literature 4: WO 2017/122276 A

SUMMARY OF INVENTION

Technical Problem

In order to solve the previously described problem, the OA-TOFMS described in Patent Literature 4 has the function of changing the voltage applied from the primary-side drive circuit of the power unit to the two ends of the primary winding of the pulse transformer according to the measurement period of the repetitive measurement, whereby a shift of the timing at which the gate voltage of the MOSFET for switching the high voltage reaches the threshold voltage can be corrected regardless of the measurement period. As a result, the timing of the start of the output of the high-voltage pulse can be consistently maintained regardless of the measurement period, and a high level of mass accuracy can be achieved. This technique has the advantage that it can deal with various measurement periods as well as consistently maintain the timing of the start of the output of the high-voltage pulse with a considerably high level of accuracy. However, a voltage source which allows the output voltage to be changed with a high level of accuracy is required as the voltage source for generating the voltage applied to the two ends of the primary winding of the pulse transformer. Furthermore, for a high-speed switching of the measurement period, the output voltage of the voltage source also needs to be switched at high speeds. Due to those requirements, it is difficult to suppress the cost increase.

Needless to say, the polarity of the high-voltage pulse should be changed according to whether the high-voltage pulse is applied to the push-out electrode 11 or extraction electrode 12. Furthermore, in the case of applying the high-voltage pulse to the push-out electrode 11 (or extraction electrode 12), the polarity of the high-voltage pulse must be changed with a change in polarity of the target ion. Specifically, for the measurement of a positive ion, the high-voltage pulse is basically a positive voltage (a voltage with the positive polarity) when applied to the push-out electrode 11, whereas the high-voltage pulse is a negative voltage (a voltage with the negative polarity) when applied to the extraction electrode 12. On the other hand, for the measurement of a negative ion, the high-voltage pulse is basically a negative voltage (a voltage with the negative polarity) applied to the push-out electrode 11, whereas the high-voltage pulse is a positive voltage (a voltage with the positive polarity) when applied to the extraction electrode 12. In the present description, such a change in voltage of the high-voltage pulse for triggering the ejection of the ions is defined as the "start of the output of the high-voltage pulse", regardless of whether the voltage is changed from a positive voltage to a negative voltage or vice versa. Additionally, as for the change in the gate voltage of the MOSFET for switching the high voltage, a voltage change from a level lower than a threshold voltage of the MOSFET to a level higher than the threshold voltage (i.e. a voltage change which turns on the MOSFET) is defined as the "rise" of the voltage, while a voltage change from a voltage higher than the threshold voltage of the MOSFET to a level lower than the threshold voltage (i.e. a voltage change which turns off the MOSFET) is defined as the "fall" of the voltage.

The present invention has been developed to solve such a problem. Its objective is to provide a time-of-flight mass spectrometer which allows for a change in measurement period of a repetitive measurement and yet can achieve a high level of mass accuracy regardless of the measurement period by reducing the temporal discrepancy between the point in time of the beginning of the time-of-flight measurement and the point in time of the ejection of the ions while suppressing the cost increase.

Solution to Problem

The present invention developed for solving the previously described problem is a time-of-flight mass spectrometer including an ion ejector configured to eject a measurement-target ion into a flight space by imparting acceleration energy by an effect of an electric field created by a voltage applied to an electrode, and a high-voltage pulse generator configured to apply a high-voltage pulse for ion ejection to the electrode, where the high-voltage pulse generator includes:

a) a DC power source configured to generate a high DC voltage;

b) a switch circuit including a switching element configured to generate the high-voltage pulse by switching the high DC voltage generated by the DC power source, and to output the high-voltage pulse to a voltage-output end;

c) a switching element driver configured to turn on/off the switching element according to a pulse signal for ejecting ions; and d) an adjustment circuit including at least a resistor inserted in series with a control terminal of the switching element on a signal path extending from the switching element driver to the control terminal, the adjustment circuit configured to make the voltage at the control terminal be a voltage having a predetermined transient characteristic.

As one mode of the present invention, the switching element driver may include: a transformer including a primary winding and a secondary winding; a primary-side driver section configured to receive a pulse signal for ejecting ions and supply a driving current to the primary winding of the transformer in response to the pulse signal; and a secondary-side driver section connected to the secondary winding of the transformer, where the secondary-side driver section is configured to turn on/off the switching element.

The time-of-flight mass spectrometer according to the present invention is suitable for a device configured to repeatedly perform, with a predetermined measurement period, a measurement in which ions are ejected from the ion ejector and detected after being made to fly in a flight space, and in which the measurement period is variable. The reason for this suitability will be evident from the following explanation.

As is explained in Patent Literature 4, a cause of the temporal fluctuation of the start of the output of the high-voltage pulse from the power unit which occurs in a conventional OA-TOFMS when the measurement period is changed is the overshoot of the voltage sent to the control terminal (gate terminal) of the switching element used for turning on/off the high DC voltage. For example, in the switching element driver in the previously described mode of the present invention, when the pulse signal is sent to the primary-side driver section in order to eject ions from the ion ejector, a voltage is applied to the control terminal of the switching element through the transformer and secondary-side driver section. This causes an overshoot of the voltage at the control terminal of the switching element due to the LC resonance circuit which is mainly formed by the leakage inductance L of the transformer and the input capacitance C of the control terminal of the switching element. After the overshoot, the voltage (in absolute value) gradually decreases with the passage of time. However, an overshoot which occurred in the previous measurement is not yet sufficiently settled at the moment when ions are about to be ejected for the next measurement. Therefore, changing the measurement period causes a change in voltage value at the beginning of the rise of the voltage applied to the control terminal, which leads to a fluctuation of the period of time from the point in time where the voltage begins to rise to the point in time where the voltage reaches the threshold voltage for the switching element. This is the cause of the temporal fluctuation of the start of the output of the high-voltage pulse due to a change in measurement period.

In the OA-TOFMS described in Patent Literature 4, which is based on the assumption that the overshoot inevitably occurs, the voltage value at the point in time where the voltage applied to the control terminal of the switching element begins to rise is changed depending on the measurement period so that the timing at which the voltage reaches the threshold voltage is consistently maintained even when the measurement period is changed. By comparison, the present invention is configured to directly suppress the overshoot of the voltage applied to the control terminal of the switching element, which is the root of the temporal fluctuation of the start of the output of the high-voltage pulse, by providing a simple adjustment circuit including a resistor which gives a predetermined transient characteristic to the voltage at the control terminal of the switching element so that the timing at which the voltage reaches the threshold voltage is consistently maintained regardless of the measurement period.

Specifically, for example, the overshoot of the voltage at the control terminal of the switching element is suppressed by an adjustment circuit formed by a resistor inserted in series immediately before the control terminal of the switching element on a signal path extending from the secondary-side driver section in the switching element driver to the control terminal. Needless to say, the suppression of the overshoot should not cause a decrease in steepness of the rise and fall of the voltage at the control terminal of the switching element, otherwise it would conversely cause a temporal discrepancy of the high-voltage pulse. Therefore, it is preferable that the transient characteristic of the voltage at the control terminal of the switching element be appropriately determined so as to prevent an excessive overshoot while maximally avoiding the decrease in steepness of the rise and fall of the voltage.

Thus, in one preferable mode of the present invention, the resistance value of the resistor in the adjustment circuit is determined so as to substantially satisfy critical damping conditions.

This configuration sufficiently suppresses the overshoot of the voltage at the control terminal of the switching element while allowing the voltage to quickly rise and fall. The temporal discrepancy of the start of the output of the high-voltage pulse is thereby reduced even in the case of using different measurement periods, so that a high level of mass accuracy is achieved regardless of the measurement period.

It should be noted that a gate capacitor having an appropriate capacitance may be added if there is a considerable decrease in voltage at the control terminal of the switching element due to the natural electric discharge.

The present invention may additionally be configured as follows:

the switch circuit includes one or more plus-side switching elements and one or more minus-side switching elements connected in series, where each of the plus-side switching elements is configured to output a plus-side voltage generated by the DC power source to the voltage-output end when in the ON state, and each of the minus-side switching elements is configured to output a minus-side voltage generated by the DC power source to the voltage-output end when in the ON state;

the switching element driver includes a first switching element driver configured to respond to a first pulse signal and electrically charge the control terminal to a voltage which turns on the plus-side switching element or a voltage which maintains the plus-side switching element in the ON state, as well as a second switching element driver configured to respond to a second pulse signal and electrically charge the control terminal to a voltage which turns on the minus-side switching element or a voltage which maintains the minus-side switching element in the ON state; and the time-of-flight mass spectrometer further includes a controller configured to generate the first pulse signal and the second pulse signal in addition to the pulse signal for starting the output of the high-voltage pulse so as to recharge the control terminal of the plus-side switching element or the minus-side switching element which is in the ON state.

In the present description, the "plus-side voltage and minus-side voltage" do not mean voltages having positive and negative polarities; they mean that the former voltage is higher than the latter. Accordingly, for example, it is possible that both the plus-side voltage and minus-side voltage are positive, or both the plus-side voltage and minus-side voltage are negative. The term "plus-side" in the "plus-side switching element" means, for example, that this switching element is located between the plus-side voltage and the voltage-output end so that the plus-side voltage is outputted to the voltage-output end when this switching element is in the ON state. Similarly, the term "minus-side" in the "minus-side switching element" means, for example, that this switching element is located between the minus-side voltage and the voltage-output end so that the minus-side voltage is outputted to the voltage-output end when this switching element is in the ON state.

According to this configuration, for example, when the first or second pulse signal for recharging is sent from the controller to the primary-side driver section in the switching element driver, the control terminal of the plus-side or minus-side switching element is recharged to a positive voltage (i.e. a voltage which turns on the switching element). The switching element is thereby maintained in the ON state, and the voltage of the high-voltage pulse is maintained in the previous state. Therefore, for example, even when the measurement period is extremely long and the time interval of the ion ejection is wide, an exact high-voltage pulse corresponding to that time interval can be generated. However, since the voltage at the charged or recharged control terminal gradually decreases due to the natural electric discharge, the voltage value at the point in time at which the voltage applied to the control terminal begins to rise varies depending on how much time has elapsed since the last charging or recharging operation when the high-voltage pulse is generated. Such a variation in voltage value leads to a temporal fluctuation of the start of the output of the high-voltage pulse.

Accordingly, as the first mode of the time-of-flight mass spectrometer having the previously described configuration, it is preferable to configure the controller to generate the second pulse signal for recharging and thereby recharge the control terminal of the minus-side switching element a specific length of time earlier than the point in time of the generation of the pulse signal for starting the output of the high-voltage pulse, when starting the output of the high-voltage pulse of the plus-side voltage, as well as generate the first pulse signal for recharging and thereby recharge the control terminal of the plus-side switching element a specific length of time earlier than the point in time of the generation of the pulse signal for starting the output of the high-voltage pulse, when starting the output of the high-voltage pulse of the minus-side voltage.

According to this configuration, the length of time elapsed from the last recharging operation to the generation of the high-voltage pulse is consistently maintained regardless of the measurement period, so that the voltage value at the point in time where the voltage applied to the control terminal of the switching element begins to rise becomes almost the same. Therefore, the charging voltage for the control terminal barely undergoes the decreasing effect due to the natural electric discharge, so that the temporal fluctuation of the start of the output of the high-voltage pulse can be even more reduced.

As the second mode of the time-of-flight mass spectrometer having the previously described configuration, a plurality of measurement periods may be set to be substantially equal to integer multiples of the shortest ion ejection period, and the resistance value of the resistor in the adjustment circuit may be determined according to the shortest ion ejection period and a control-terminal-recharging period with which the controller repeatedly sends the pulse signal for recharging.

As is evident from the previous description, the extent of the overshoot of the voltage applied to the control terminal of the switching element as well as the extent of the decrease in steepness of the waveform in the rising or falling phase of the voltage can be regulated by adjusting the resistance value of the resistor in the adjustment circuit. As in the first mode, even if it is impossible to synchronize the timing of sending the pulse signal for starting the output of the high-voltage pulse and the timing of sending the pulse signal for recharging, i.e. even if it is impossible to send the pulse signal for recharging a fixed length of time earlier than the point in time where the pulse signal for starting the output of the high-voltage pulse is sent, the voltage at the control terminal should gradually change with the repetition of the recharging if the relationship between the shortest ion ejection period and the control-terminal-recharging period is previously determined. Therefore, it is possible to almost equalize the voltage value of the voltage applied to the control terminal in generating the high-voltage pulse, by adjusting the extent of the overshoot of the voltage applied to the control terminal of the switching element or the extent of the decrease in steepness of the waveform in the rising or falling phase of the voltage according to the state of change in the voltage. By such an operation, as in the first mode, the temporal fluctuation of the start of the output of the high-voltage pulse can be even more reduced.

In a specific example of the second mode, the control-terminal-recharging period is shorter than the shortest ion ejection period, and the resistance value of the resistor in the adjustment circuit is determined so that the state of over-damping occurs. In some cases, the control-terminal-recharging period may be longer than the shortest ion ejection period, and the resistance value of the resistor in the adjustment circuit may be determined so that the state of insufficient damping occurs.

The present invention is applicable in any type of time-of-flight mass spectrometer configured to accelerate ions and send them into a flight space by an electric field created by applying a high-voltage pulse to an electrode in an ion ejector. That is to say, the present invention is not only naturally applicable in an orthogonal acceleration type of time-of-flight mass spectrometer but is also applicable in an ion trap time-of-flight mass spectrometer configured to accelerate ions held within an ion trap and send them into a flight space, as well as in a time-of-flight mass spectrometer configured to accelerate ions generated from a sample by matrix assisted laser desorption/ionization (MADLI) or similar methods and send them into a flight space.

Advantageous Effects of Invention

According to the present invention, the timing to apply the high-voltage pulse to the electrode for ejecting ions can be consistently maintained even when the measurement period of a repetitive measurement is changed, so that a high level of mass accuracy can be realized regardless of the measurement period. To achieve such an effect, the present invention merely requires adding, to a conventional device, a simple circuit formed by a resistor and other inexpensive circuit elements. Thus, it is possible to suppress the cost increase while ensuring a high level of mass accuracy which is independent of the measurement period.

BRIEF DESCRIPTION OF DRAWINGS

FIG. 1 is a schematic configuration diagram of an OA-TOFMS as one embodiment of the present invention.

FIGS. 2A-2E are charts showing waveforms in the main components of an acceleration voltage generator of the OA-TOFMS according to the present embodiment.

DESCRIPTION OF EMBODIMENTS

An OA-TOFMS as one embodiment of the present invention is hereinafter described with reference to the attached drawings.

Figure 3:
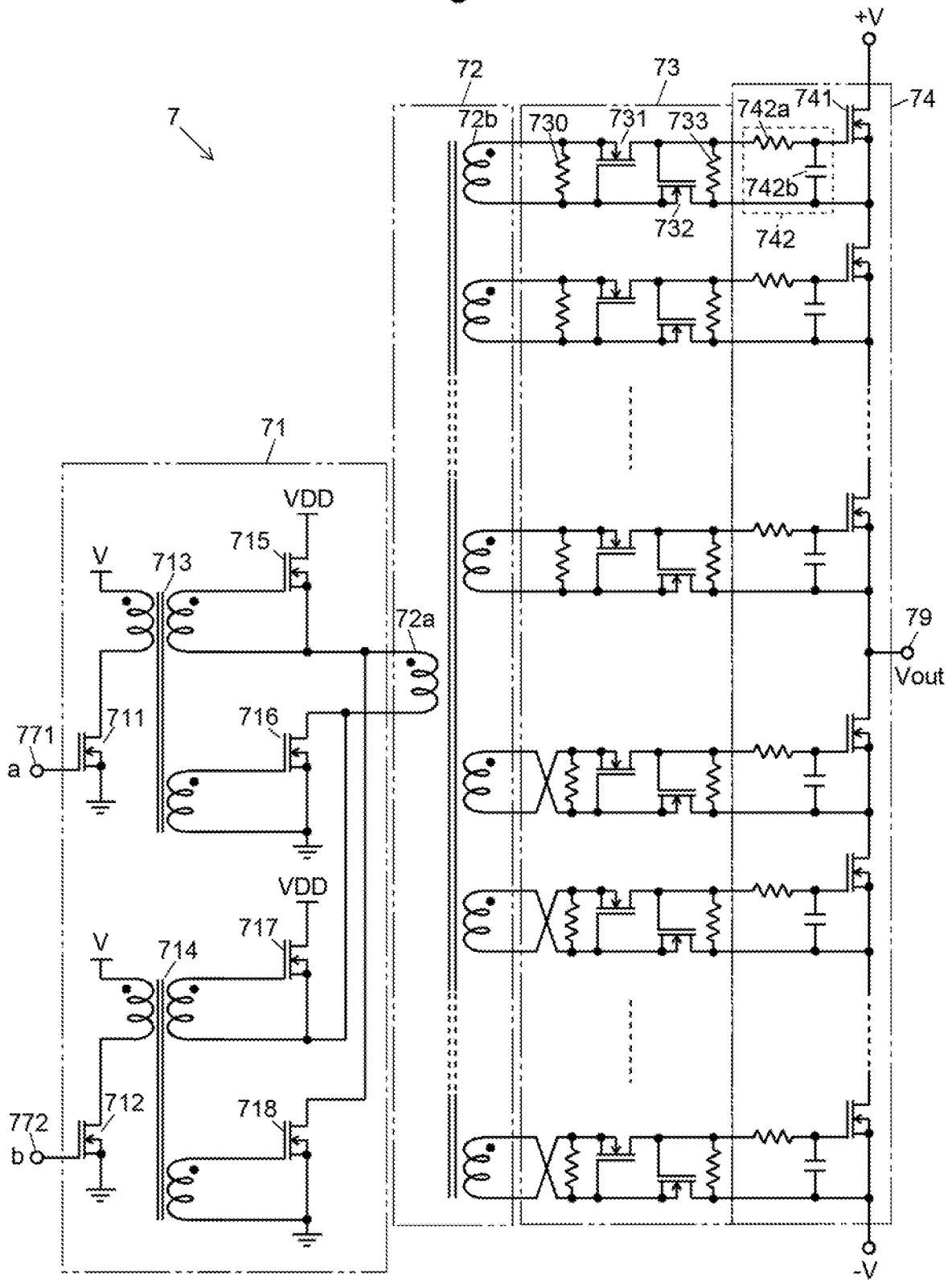
FIG. 3 is a schematic circuit configuration diagram of the acceleration voltage generator of the OA-TOFMS according to the present embodiment.
Figure 12:
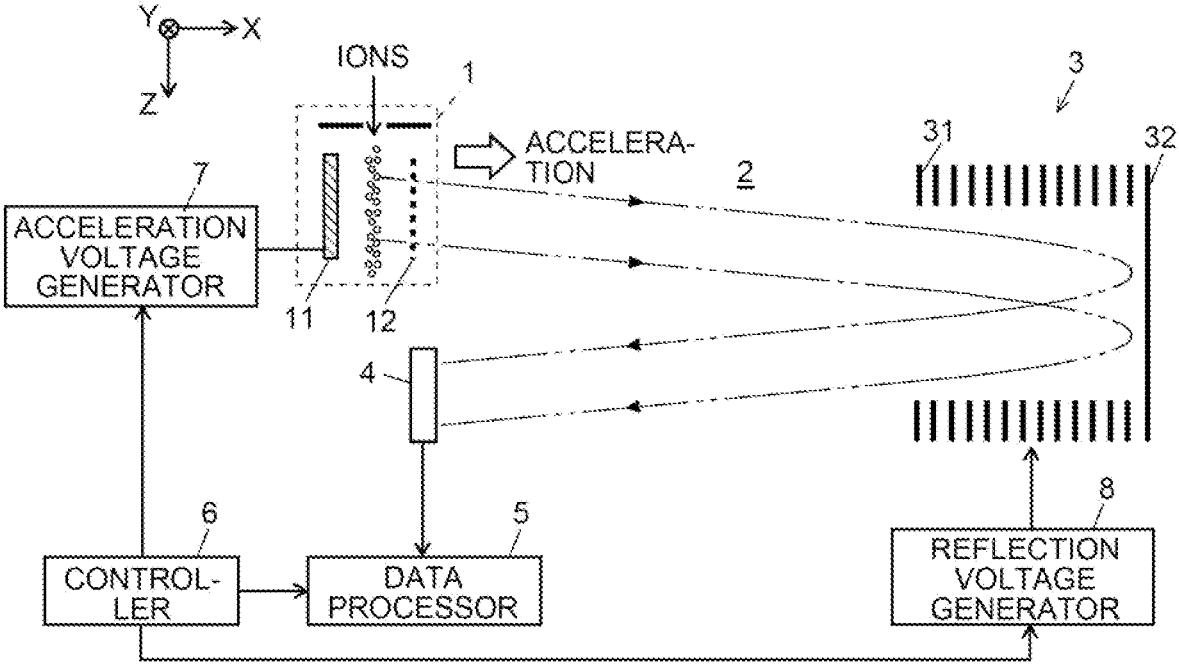
Fig. 12 PRIOR ART
FIG. 12 is a schematic configuration diagram of a conventional and common type of OA-TOFMS.

FIG. 1 is a schematic configuration diagram of the OA-TOFMS according to the present embodiment. FIG. 3 is a schematic circuit configuration diagram of an acceleration voltage generator in the OA-TOFMS. The same components as already described and shown in FIG. 12 will be denoted by the same reference signs, and descriptions of those components will be omitted. It should be noted that the data processor 5 shown in FIG. 12 is omitted in FIG. 1 in order to avoid complexity.

In the OA-TOFMS according to the present embodiment, the acceleration voltage generator 7 includes a primary-side driver section 71, pulse transformer 72, secondary-side driver section 73, switch circuit 74, high-voltage power source 75, and primary-side power source 76. The controller 6 control the switching operation in the switch circuit 74 to control the primary-side driver section 71.

As shown in FIG. 3, the switch circuit 74 in the acceleration voltage generator 7 has a plus side (the side upper than the voltage-output end 79 in FIG. 3) and a minus side (the side lower than the voltage-output end 79 in FIG. 3), with each side including a series circuit of switching elements formed by a plurality of power MOSFETs 741 connected in series. The voltages +V and −V applied from the high-voltage power source 75 to the two ends of the series circuit of switching elements depend on the polarity of the measurement-target ion and the type of electrode (push-out electrode 11 or extraction electrode 12) to which the high-voltage pulse is applied. When the ion is a positive ion and the high-voltage pulse is applied to the push-out electrode 11, +V=2500V and −V=0V, for example. When the ion is a negative ion and the high-voltage pulse is applied to the push-out electrode 11, +V=0V and −V=−2500V, for example. In general, it is more common that the ion is a positive ion. Therefore, the following descriptions are given on the assumption that the ion is a positive ion and the high-voltage pulse is applied to the push-out electrode 11, although the ion may be a negative ion, as will be described later. Additionally, the ejection of the ion may be achieved by applying a high-voltage pulse to the extraction electrode 12.

The pulse transformer 72 is a ring-core transformer. One ring core is provided for the gate terminal of the MOSFET 741 in each stage of the switch circuit 74. The secondary winding 72*b* wound on each ring core is connected to the transformer load resistor 730 and the MOSFETs 731 and 732 in the secondary-side driver section 73. A single turn of cable passed through the ring core is used as the primary winding 72*a*. For this cable, a high-voltage insulated wire is used, which electrically insulates the primary side from the secondary side. The number of turns of the secondary winding may be appropriately determined.

The primary-side driver section 71 includes a plurality of MOSFETs 711, 712 and 715-718, as well as a plurality of transformers 713 and 714. Pulse signals a and b are sent from the controller 6 to a plus-side pulse signal input end 771 and minus-side pulse signal input end 772, respectively.

The term "plus-side" in the "plus-side pulse signal input end 771" means that an input of a high-level signal to this input end turns on the plus-side MOSFET 741 (or maintains it in the ON state), as in a circuit operation which will be described later. Similarly, the term "minus-side" in the "minus-side pulse signal input end 772" means that an input of a high-level signal to this input end turns on the minus-side MOSFET 741 (or maintains it in the ON state), as in a circuit operation will be described later.

As shown in FIGS. 2A and 2B, under the condition that the gate voltage a has been maintained at a negative voltage and the gate voltage b at a positive voltage by an input of the pulse signal b at a point in time earlier than t0, the MOSFET 771 is turned on at time t0 by an input of a high-level pulse signal a to the plus-side pulse signal input end 771. This produces an electric current flowing through the primary winding of the transformer 713, which induces a predetermined voltage between the two ends of the secondary winding. Thus, the MOSFETs 715 and 716 both turn on. Since the MOSFET 712 is in the OFF state at this point, no electric current flows through the primary winding of the transformer 714, so that the MOSFETs 717 and 718 are both in the OFF state. Consequently, the voltage VDD supplied from the primary-side power source 76 is applied between the two ends of the primary-side winding 72*a* of the pulse transformer 72, and an electric current flows through the primary winding 72*a* in the downward direction in FIG. 3.

Thus, a predetermined voltage is induced between the two ends of each secondary winding 72*b* of the pulse transformer 72. The voltage applied to the gate terminal of each MOSFET 741 via the transformer load resistor 730, MOSFETs 731 and 732, and gate discharge resistor 733 in the secondary-side driver section 73 as well as an adjustment circuit 742 in the switch circuit 74 (this voltage is hereinafter called the "gate voltage") can be approximately expressed by the following equation:

$$[\text{Gate Voltage}] \approx \{[\text{Primary-Side Voltage of Pulse Transformer 72}]/[\text{Number of MOSFETs 741 Serially Connected in Switch Circuit 74}]\} \times [\text{Number of Turns of Secondary Winding of Pulse Transformer 72}] \quad (1)$$

For example, if the primary-side voltage (VDD) of the pulse transformer 72 is 175 V, number of MOSFETs 741 connected in series in the switch circuit 74 is 12, and number of turns of the secondary winding of the pulse transformer 72 is one, a voltage which is approximately 174/12=14 V is applied to the gate terminal of each MOSFET 741.

When the voltage is applied in the forward direction between the gate terminal and source terminal of the six plus-side MOSFETs 741 in the switch circuit 74, those MOSFETs 741 simultaneously turn on. Meanwhile, the voltage is also applied in the reverse direction between the gate terminal and source terminal of the six minus-side MOSFETs 741 in the switch circuit 74, those MOSFETs 741 turns off. As a result, the voltage-supply end +V from the high-voltage power source 75 is almost directly connected to the voltage-output end 79, and a voltage of +V=+2500V is outputted to the voltage-output end 79.

At time t1, the pulse signal a inputted to the plus-side pulse signal input end 771 is changed to the low level (voltage zero). Then, the voltage between the two ends of each primary winding 72*a* in the pulse transformer 72 becomes zero. However, the gate voltage of the MOSFET 741 is roughly maintained at the same level by the electric charges already accumulated in the input capacitance of the gate terminal of the MOSFET 741, i.e. by the charging voltage for the gate terminal. The output voltage from the voltage-output end 79 is maintained at +V=+2500V. At a later point in time t2, the pulse signal b inputted to the minus-side pulse signal input end 772 is changed to the high level. This time, the MOSFET 712 turns on, which turns on the MOSFETs 717 and 718. A voltage is thereby applied between the two ends of the primary winding 72*a* in the pulse transformer 72 in the direction opposite to the previous direction, thereby producing an electric current flowing in the opposite direction. Consequently, a voltage is induced between the two ends of each secondary winding 72*b* of the pulse transformer 72 in the direction opposite to the previous direction, so that the six plus-side MOSFETs 741 in the switch circuit 74 turn off, while the six minus-side MOSFETs 741 turn on. Consequently, the output voltage from the voltage-output end 79 becomes zero (i.e. the value of −V).

When the pulse signal b inputted to the minus-side pulse signal input end 772 is changed to the low level (voltage zero), the voltage between the two ends of the primary winding 72*a* of the pulse transformer 72 becomes zero. However, the gate voltage of the MOSFETs 741 is roughly maintained at the same level by the electric charges already accumulated in the input capacitance of the gate terminal of each of the six minus-side MOSFETs 741, i.e. by the charging voltage for the gate terminal. Consequently, the output voltage from the voltage-output end 79 is maintained at 0V.

By the previously described basic operation, the acceleration voltage generator 7 generates a high-voltage pulse with a pulse peak value of +2500V at the timing corresponding to the pulse signals a and b inputted to the plus-side pulse signal input end 771 and minus-side pulse signal input end 772. As is evident from FIGS. 2A-2E, the pulse duration of this high-voltage pulse is approximately equal to the period of time from the rise of the pulse signal a to that of the pulse signal b.

In advance of a description concerning how the adjustment circuit 742 located between the secondary-side driver section 73 and the gate terminals of the MOSFETs 741 functions in the previously described operation, a specific description will be hereinafter given concerning a problem which occurs if the adjustment circuit 742 is not present, i.e. a problem with the conventional circuit.

Figure 13:
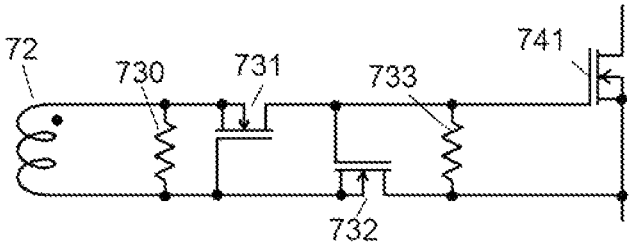
Fig. 13 PRIOR ART
FIG. 13 is a circuit configuration diagram of the secondary-side driver section and MOSFET in an acceleration voltage generator of a conventional OA-TOFMS.
Figure 14:
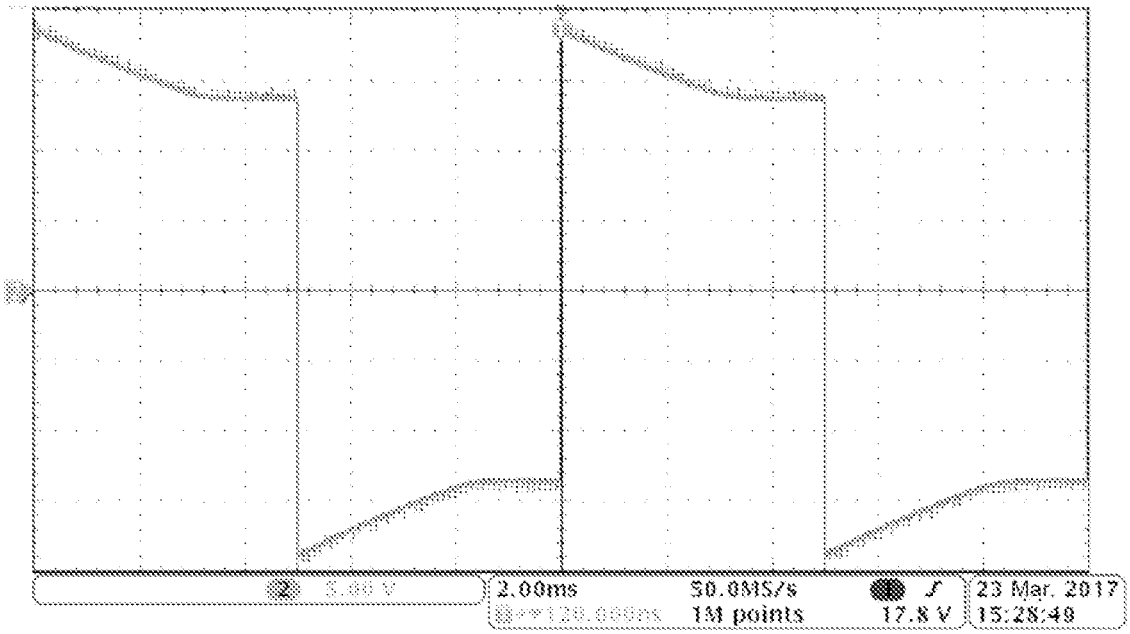
Fig. 14 PRIOR ART
FIG. 14 is a graph showing a measured waveform of the gate voltage in a conventional OA-TOFMS.
Figure 19:
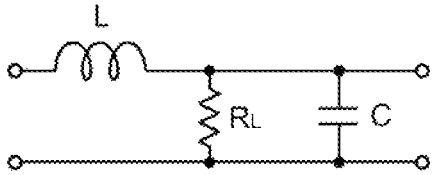
Fig. 19 PRIOR ART
FIG. 19 is a schematic equivalent circuit on the gate-terminal side of the MOSFET in the circuit shown in FIG. 13.

FIG. 13 is a circuit configuration diagram of one stage of the secondary-side driver section 73 and MOSFET 741 in the acceleration voltage generator 7 in a conventional OA-TOFMS which does not have the adjustment circuit 742. FIG. 19 is a schematic equivalent circuit of the gate-terminal side of the MOSFET in the circuit shown in FIG. 13. FIG. 14 is a graph showing a measured waveform of the gate voltage in the present case.

In the secondary-side circuit of the pulse transformer 72, a resonance occurs in the LC circuit including the leakage inductance L of the pulse transformer 72 and the input capacitance C of the control terminal of the MOSFET 741. Therefore, an overshoot as shown in FIG. 14 occurs in both the rising phase and falling phase of the gate voltage. After the overshoot, the voltage (in absolute value) gradually decreases with the passage of time and is ultimately stabilized at a predetermined voltage. The settling time required for the settling of the overshoot is normally a few to several milliseconds.

As noted earlier, the timing of the start of the output of the high-voltage pulse is determined by the timing at which the MOSFETs 741 in the switch circuit 74 turn on/off, i.e. the timing of the rise/fall of the gate voltage of those MOSFETs 741. For example, in the case of the waveform shown in FIGS. 2A-2E, the timing at which the high-voltage pulse shown in FIG. 2E changes from −V (0V) to +V (2500V) is determined by both the timing at which the gate voltage of the plus-side MOSFET 741 (see FIG. 2C) changes from the negative voltage to the positive voltage, and the timing at which the gate voltage of the minus-side MOSFET 741 (see FIG. 2D) from the positive voltage to the negative voltage. The threshold of the gate voltage of the MOSFETs 741 used in the present case is approximately 3V. For example, the MOSFET 741 turns from OFF to ON when the rising slope of the gate voltage crosses this threshold voltage.

Figure 15:
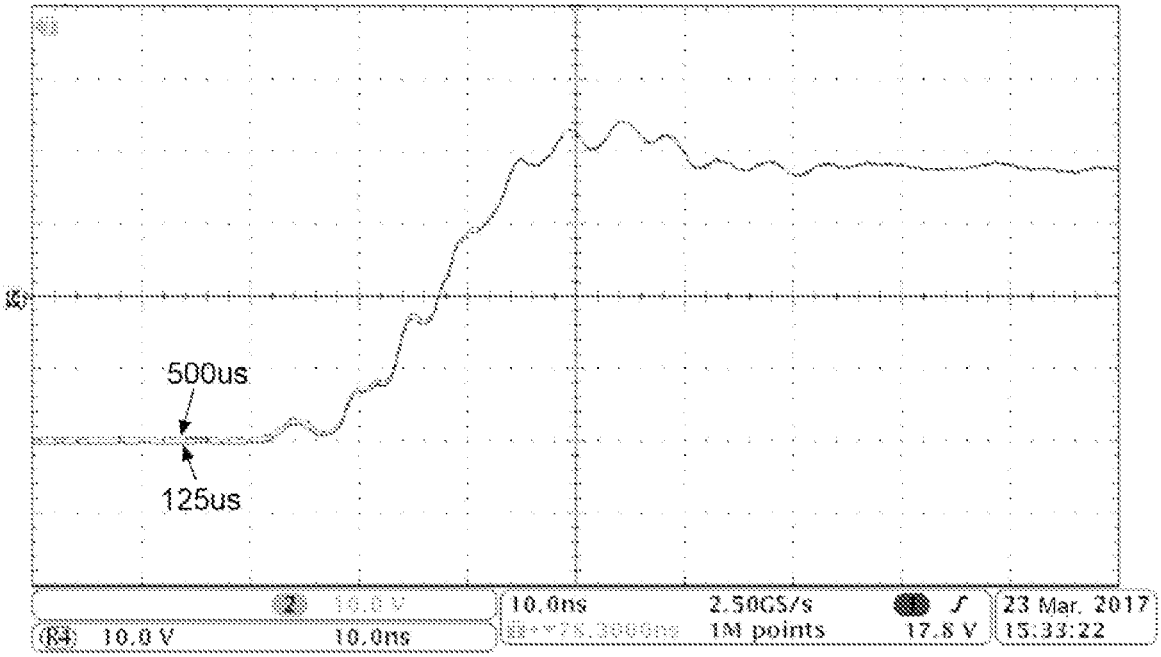
Fig. 15 PRIOR ART
FIG. 15 is a graph showing a measured waveform of the gate voltage in a switching operation from a negative voltage to a positive voltage, with the measurement period set at 125 μs and 500 μs in a conventional OA-TOFMS.
Figure 16:
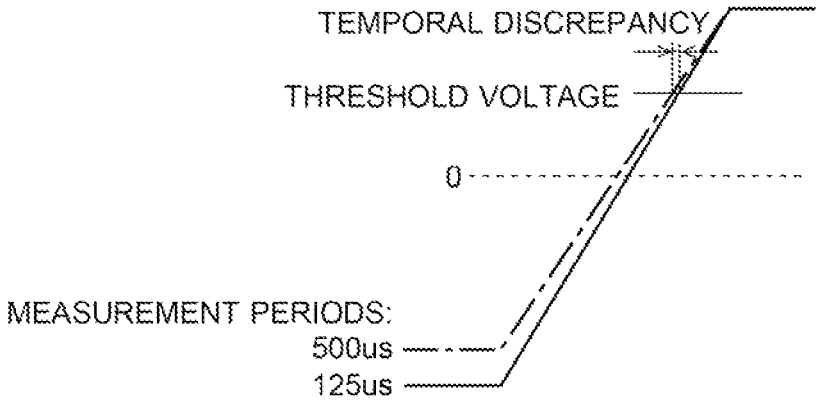
Fig. 16 PRIOR ART
FIG. 16 is a conceptual diagram illustrating a difference in gate voltage in the case of using different measurement periods.

In principle, the rising/falling waveform of the gate voltage should be unaffected by the measurement period of the repetitive measurement. However, when the ion ejection period is changed in order to change the measurement period, the phenomenon of a slight change in the rising/falling waveform of the gate voltage is observed. FIG. 15 is a measured waveform of the gate voltage in a switching operation from a negative voltage to a positive voltage, with the measurement period set at 125 μs and 500 μs. FIG. 16 is a model diagram of the rising slope of the voltage in FIG. 15.

In the present example, the gate terminal of the MOSFET 741 is charged from ~19.0V to a predetermined positive voltage when the measurement period is 125 μs, whereas the gate terminal is charged from ~18.3V to the predetermined positive voltage when the measurement period is 500 μs. That is to say, the voltage at the point in time where the gate voltage begins to rise varies depending on the measurement period. This is due to the effect of the overshoot mentioned earlier. The measurement period is one order of magnitude shorter than the settling time of the overshoot, which is a few to several milliseconds. Accordingly, it is necessary to generate the high-voltage pulse for the next measurement while the voltage is gradually decreasing (toward the target voltage) after the overshoot as shown in FIG. 14. Accordingly, the extent of the recovery from the overshoot varies depending on the measurement period, which means that the voltage at the point in time where the gate voltage begins to rise also varies.

Such a variation in the voltage at the point in time where the gate voltage begins to rise causes a shift of the point in time where the gate voltage reaches the threshold voltage, as shown in FIG. 16. This leads to a shift of the timing at which the MOSFET 741 turns on/off, which in turn causes a shift of the point in time where the high-voltage pulse begins to rise. Specifically, in the present case, when the measurement period is 500 μs, the gate voltage reaches the threshold voltage and triggers the start of the output of the high-voltage pulse earlier than when the measurement period is 125 μs.

Figure 17:
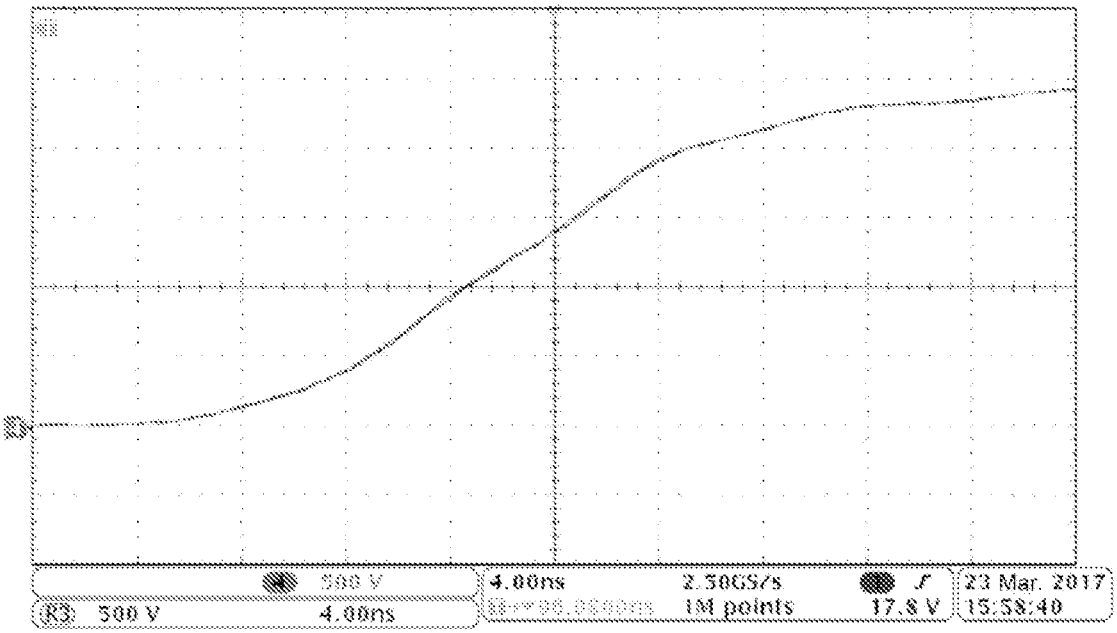
Fig. 17 PRIOR ART
FIG. 17 is a graph showing a measured waveform of the output voltage in a conventional OA-TOFMS.
Figure 18:
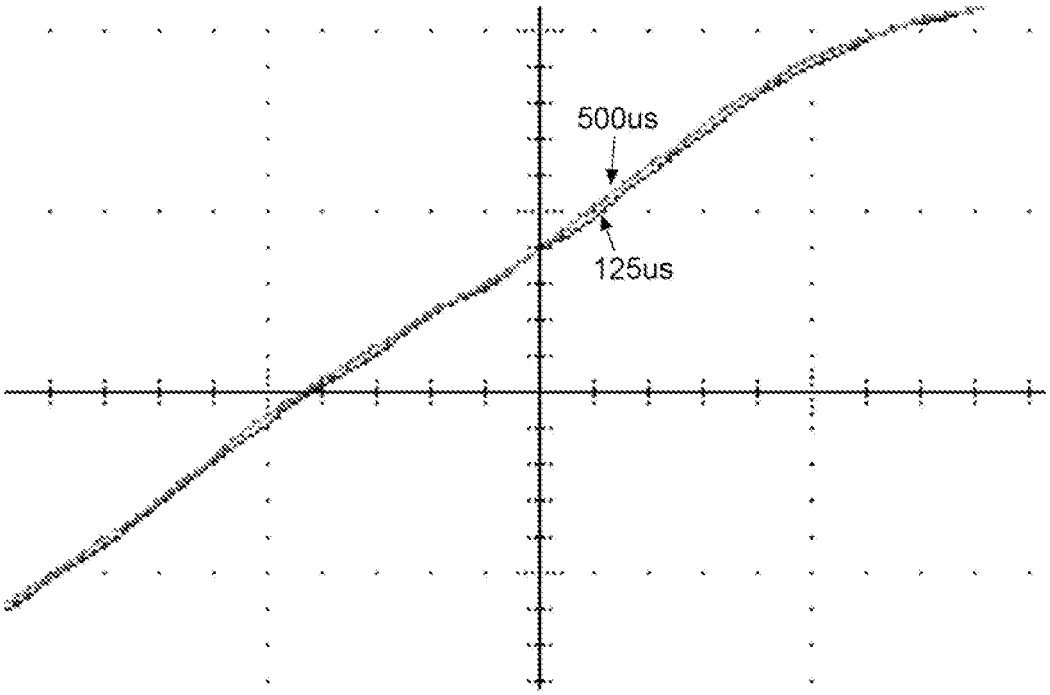
Fig. 18 PRIOR ART
FIG. 18 is a partially enlarged view of the waveform of the output voltage shown in FIG. 17.

FIG. 17 shows a measured waveform of the output voltage of the high-voltage pulse in the present case. FIG. 18 is a partially enlarged view of FIG. 17. In the example of FIGS. 17 and 18, there is a temporal discrepancy of approximately 150 ps between the case with the measurement period of 125 μs and the case with the measurement period of 500 μs. This temporal discrepancy corresponds to a mass discrepancy of approximately 5 ppm at m/z=1000. Precise mass measurements require the mass discrepancy to be equal to approximately 1 ppm or even smaller. A mass discrepancy of 5 ppm is not allowable for precise mass measurements.

Figure 20:
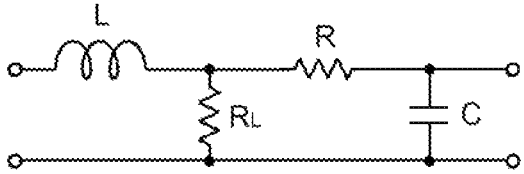
FIG. 20 is an equivalent circuit created by adding a gate resistor to the schematic equivalent circuit shown in FIG. 13.

In the OA-TOFMS according to the present embodiment, the adjustment circuit 742 including the gate resistor 742*a* has the function of eliminating the temporal discrepancy of the output voltage waveform depending on a change in measurement period which occurs due to the previously described cause. FIG. 20 is a schematic equivalent circuit created by adding a gate resistor to the schematic equivalent circuit shown in FIG. 13, i.e. a schematic equivalent circuit on the gate-terminal side of the MOSFET 741 in the OA-TOFMS according to the present embodiment.

As shown in FIG. 3, the adjustment circuit 742 includes a gate resistor 742*a* serially inserted between the MOSFET 731 in the secondary-side driver section 73 and the gate terminal of the MOSFET 741 for turning on/off the high voltage, as well as a gate capacitor 742*b* connected in parallel between the gate and drain terminals of the MOSFET 741. If the input capacitance of the gate terminal of the MOSFET 741 is large to a certain extent, the input capacitance of the gate terminal can be used in place of the gate capacitor 742*b*, and it is unnecessary to add the gate capacitor 742*b* as an independent element. In that case, the gate resistor 742*a* is practically the only element to be added (i.e. the adjustment circuit 742 practically consists of only the gate resistor 742*a*).

As shown in FIG. 20, the input-side circuit of the gate terminal of the MOSFET 741 including the adjustment circuit 742 is an LCR circuit, whose transient characteristic depends on the resistor R. The resistor R suppresses the ringing (i.e. overshoot) in the step response waveform. However, it also causes a decrease in steepness of the waveform in the rising phase. Therefore, it is necessary to appropriately determine the resistance value of the gate resistor 742*a* so that neither the overshoot nor the decrease in steepness in the rise (or fall) of the waveform occurs (i.e. the waveform becomes substantially rectangular) when the voltage applied to the gate terminal of the MOSFET 741 is changed as shown in FIGS. 2C and 2D.

Figure 4A:
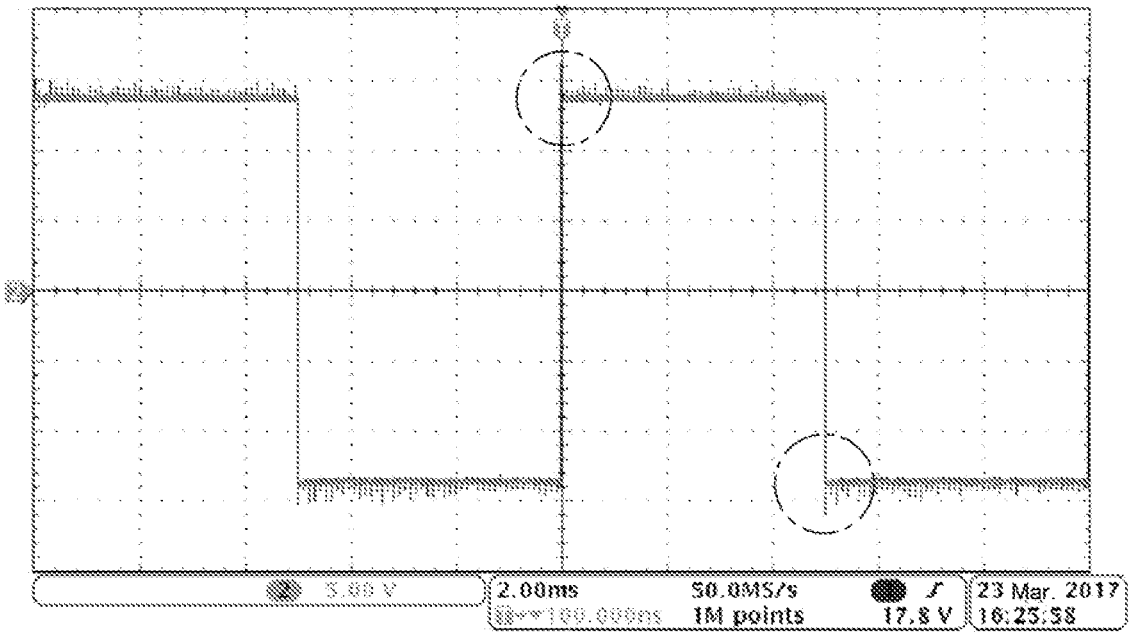
FIG. 4A is a graph showing a measured waveform of the gate voltage in a high-voltage-on/off MOSFET in the case where the resistance value of the resistor in the adjustment circuit is 3.3Ω in the OA-TOFMS according to the present embodiment.
Figure 4B:
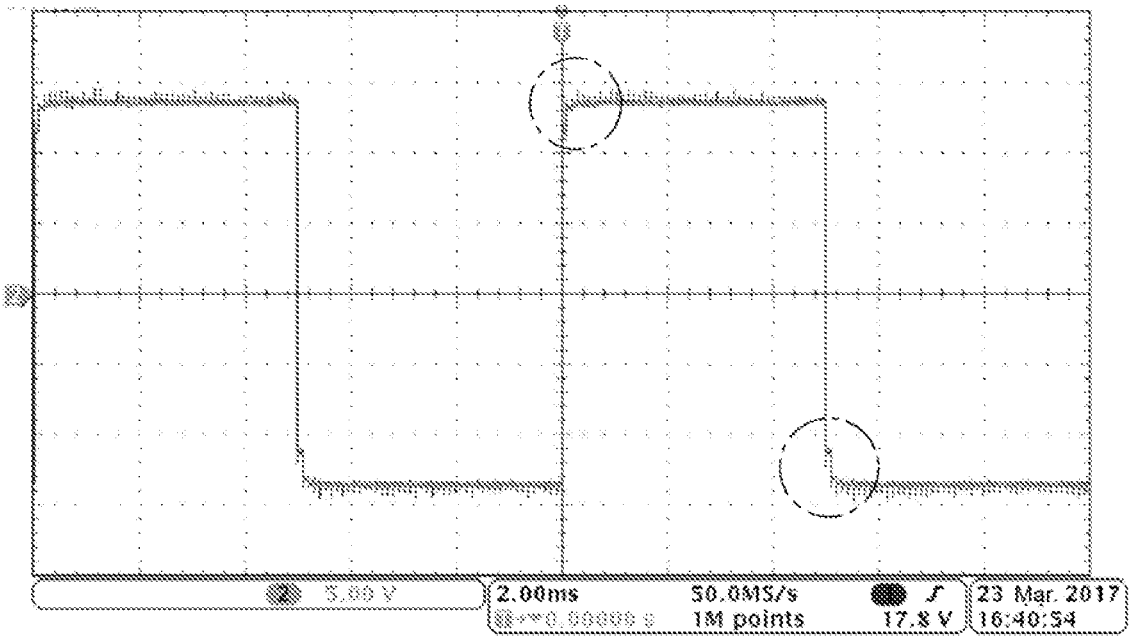
FIG. 4B is a similar graph in the case where the resistance value is 10Ω.

FIG. 4A is a chart showing a measured waveform of the gate voltage in the MOSFET 741 in the case where the resistance value Rg of the gate resistor 742*a* is 3.3Ω, and FIG. 4B is a similar chart in the case where the resistance value Rg is 10Ω. It can be seen that, when Rg=3.3Ω, there is no overshoot with the waveform being satisfactory (almost rectangular) in both the rising and falling phases. That is to say, this can approximately be considered as the state of critical damping. On the other hand, when Rg=10Ω, the steepness of the waveform is decreased in both the rising and falling phases, which is the state of overdamping. When the overshoot of the gate voltage is eliminated as shown in FIG. 4A, a change in measurement period barely causes a variation in voltage at the point in time where the gate voltage begins to rise, so that the shift of the point in time at which the gate voltage reaches the threshold voltage is also reduced. Consequently, the timing discrepancy of the generation of the high-voltage pulse is practically eliminated, and the accuracy of the time-of-flight measurement is improved.

In general, the elements used in each stage of the secondary-side drive section 73 or switch circuit 74 are the same. Therefore, the gate voltages respectively applied to the gate terminals of the MOSFETs 741 in those stages are almost equal to each other. Accordingly, in normal cases, the resistance values of the gate resistors 742*a* in those stages may also be the same. The appropriate resistance value of those gate resistors 742*a* can be experimentally determined by the manufacturers who offer the present device.

As just described, the timing discrepancy of the generation of the high-voltage pulse due to a change in measurement period can be sufficiently decreased by providing the adjustment circuit 742 having a simple configuration on the wiring connected to the gate terminal of the MOSFET 741 in each stage. In the OA-TOFMS according to the present embodiment, the timing discrepancy of the generation of the high-voltage pulse due to the change in measurement period can be even more reduced by additionally performing a control which will be hereinafter described.

As shown in FIG. 2E, the voltage at the voltage-output end 79 is maintained at −V (in the previous example, −V=0) during the period of time from the generation of one high-voltage pulse to that of the next high-voltage pulse. To this end, even after the pulse signal b is changed from the high level to the low level, the minus-side MOSFET 741 in the switch circuit 74 must be continuously maintained in the ON state, and conversely, the plus-side MOSFET 741 must be continuously maintained in the OFF state. While the pulse signal b is at the high level, the input capacitance of the gate terminal of the MOSFET 741 is charged by the electric current flowing from the secondary winding 72*b* of the pulse transformer 72. The charging voltage remains even after the pulse signal b is changed to the low level. However, the voltage gradually decreases with the passage of time due to the natural electric discharge. In order to assuredly prevent the gate voltage of the minus-side MOSFET 741 from being lower than the threshold voltage, the pulse signal b is inputted to the minus-side pulse signal input end 772 at appropriate intervals of time during the period of time where no high-voltage pulse is generated, so as to apply a pulsed voltage to the gate terminal of the minus-side MOSFET 741 and recharge the input capacitance of the gate terminal. For distinction from the pulse signal b used for generating the high-voltage pulse, the pulse signal used for charging the input capacitance of the gate terminal is hereinafter called the "dummy-pulse signal" and denoted by reference sign b'.

Figure 5A:
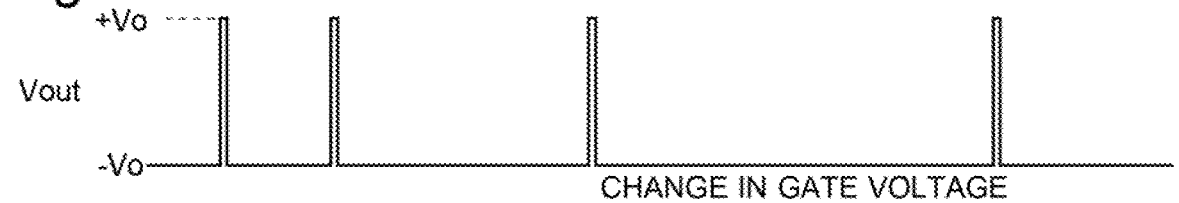
FIGS. 5A-5C are timing charts showing one example of the relationship of the gate voltage, output voltage and dummy-pulse signal of the high-voltage-on/off MOSFET in the OA-TOFMS according to the present embodiment.
Figure 5B:
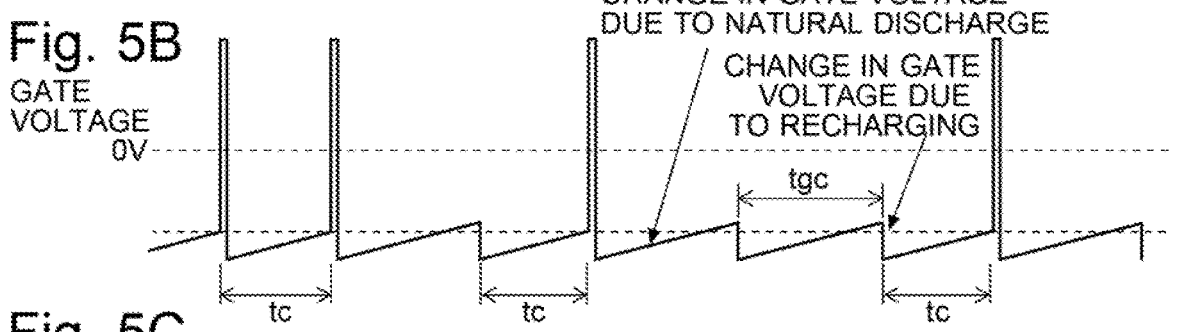
Figure 5C:
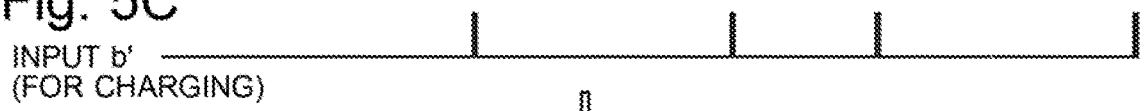
Figure 5D:
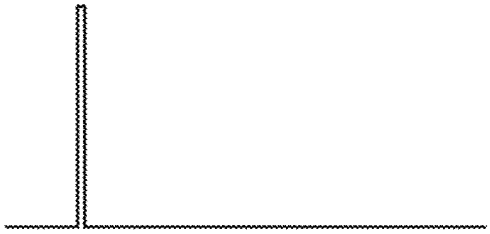
FIG. 5D is a chart showing the transient characteristic of the gate voltage of the MOSFET from which a change in gate voltage due to the natural electric discharge or recharging process observed in FIG. 5B has been subtracted.

FIGS. 5A-5C are timing charts showing one example of the relationship of the gate voltage of the plus-side MOSFET 741, output voltage (high-voltage pulse) and dummy-pulse signal b'. FIG. 5D is a chart showing the transient characteristic of the gate voltage of the plus-side MOSFET 741 in the present embodiment from which a change in gate voltage due to the natural electric discharge or the recharging observed in FIG. 5B has been subtracted. The chart shows the state of critical damping in which neither the overshoot nor the decrease in steepness of the waveform is present.

The temporal interval of the high-voltage pulse shown in FIG. 5A varies depending on the measurement period. After a predetermined period of time tgc has passed since the previous delivery of the dummy-pulse signal b', the controller 6 generates another dummy-pulse signal b' and sends it to the minus-side pulse signal input end 772. The controller 6 also generates a dummy-pulse signal b' and sends it to the minus-side pulse signal input end 772 a specific period of time tc earlier than the point in time of the generation of the high-voltage pulse (see FIG. 5C). As described earlier, inputting the dummy-pulse signal b' recharges the input capacitance of the gate terminal of the MOSFET 741, whereby the gate voltage is approximately maintained at a constant voltage. When the specific period of time tc has passed since that point in time, the pulse signal a for starting the output of the high-voltage pulse is inputted. Thus, the decrease in the charging voltage of the MOSFET 741 due to the natural electric discharge is almost constantly maintained regardless of the measurement period, whereby the temporal discrepancy of the start of the output is reduced.

In order to perform the previously described control, it is necessary to generate either the dummy-pulse signal b' at the timing which is the specific period of time tc earlier than the point in time of the generation of the high-voltage pulse, or to initially generate the dummy-pulse signal b' in response to a command for the execution of the measurement and subsequently generate the high-voltage pulse after the passage of the specific period of time tc. Therefore, the previously described control cannot be performed in the case where the generation of the high-voltage pulse and that of the dummy-pulse signal b' are not synchronized with each other in the controller 6. In such a case, it is preferable to perform the following control.

Figure 6A:
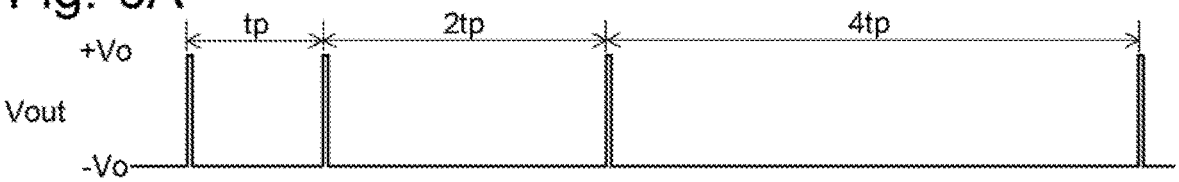
FIGS. 6A-6C are timing charts showing another example of the relationship of the gate voltage, output voltage and dummy-pulse signal of the high-voltage-on/off MOSFET in the OA-TOFMS according to the present embodiment.
Figure 6B:
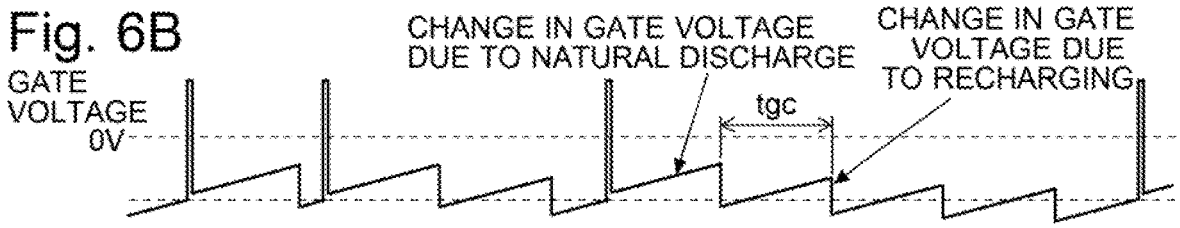
Figure 6C:
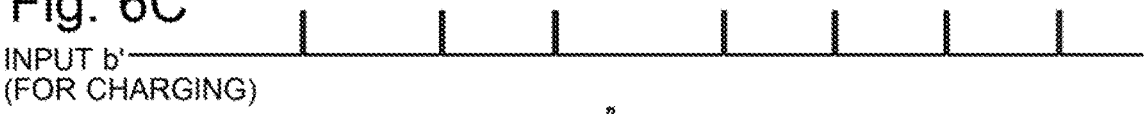
Figure 6D:
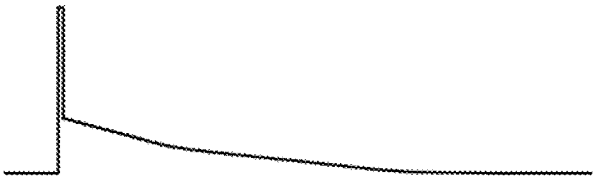
FIG. 6D is a chart showing the transient characteristic of the gate voltage of the MOSFET from which a change in gate voltage due to the natural electric discharge or recharging process observed in FIG. 6B has been subtracted.
Figure 7A:
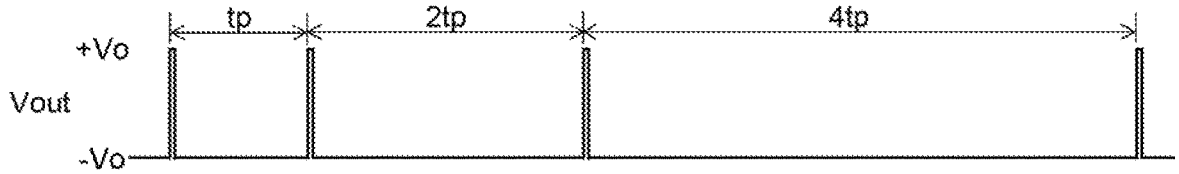
FIGS. 7A-7C are timing charts showing still another example of the relationship of the gate voltage, output voltage and dummy-pulse signal of the high-voltage-on/off MOSFET in the OA-TOFMS according to the present embodiment.
Figure 7B:
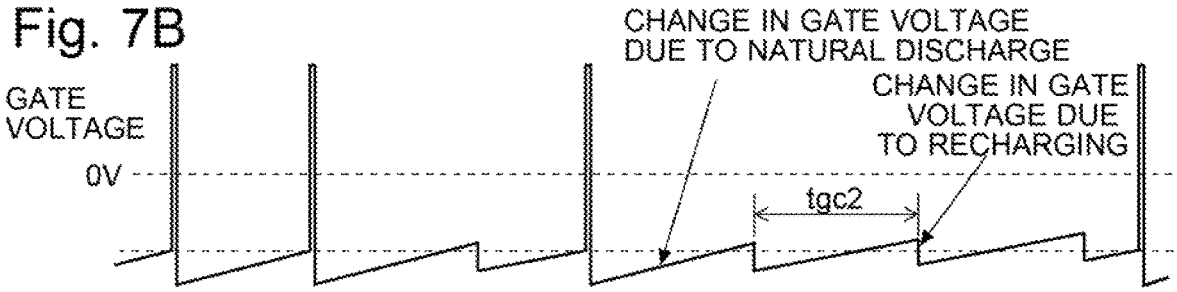
Figure 7C:
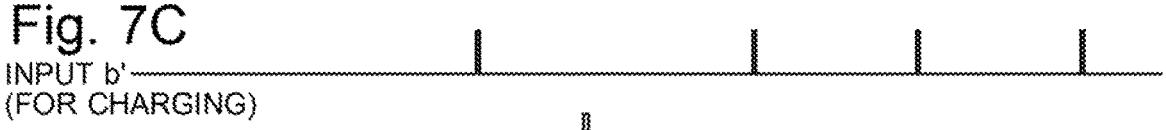
Figure 7D:
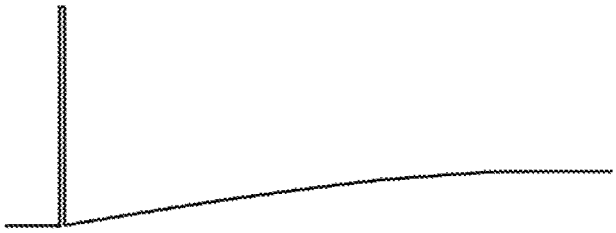
FIG. 7D is a chart showing the transient characteristic of the gate voltage of the MOSFET from which a change in gate voltage due to the natural electric discharge or recharging process observed in FIG. 7B has been subtracted.

FIGS. 6A-6C and FIGS. 7A-7C are timing charts respectively showing other examples of the relationship of the gate voltage of the plus-side MOSFET 741, output voltage (high-voltage pulse) and dummy-pulse signal b'. FIGS. 6D and 7D are charts showing the transient characteristic of the gate voltage of the plus-side MOSFET 741 in each embodiment from which a change in gate voltage due to the natural electric discharge or the recharging observed in FIG. 6B or 7B has been subtracted, respectively.

In this case, the plurality of ion ejection periods (measurement periods) are set to be equal to integer multiples of the shortest ion ejection period tp. For example, if the shortest ion ejection period tp is 125 μs, the ion ejection periods are set at 125 μs, 250 μs and 500 μs. On the other hand, the gate-charging period tgc, which is the period of the generation of the dummy pulse signal b', is set to be slightly shorter or longer than the shortest ion ejection period tp. For example, if the shortest ion ejection period tp is 125 μs, the gate-charging period tgc is set at 105 μs or 150 μs.

[Case 1] Shortest Ion Ejection Period tp>Gate-Charging Period tgc (FIGS. 6A-6D) For example, this is the case where the shortest ion ejection period tp is 125 μs and the gate-charging period tgc is 105 μs. Since the shortest ion ejection period tp>the gate-charging period tgc, at least one dummy-pulse signal b' is inputted within one measurement period regardless of the measurement period, as shown in FIGS. 6A-6D. In this case, the longer the measurement period is, the longer the period of time becomes from the point in time of the last charging of the gate terminal to the point in time of the generation of the high-voltage pulse, as shown in FIG. 6B. This leads to a greater decrease in charging voltage due to the natural electric discharge. In order to cancel this decrease in voltage, the waveform in the falling phase of the gate voltage is intentionally made to be less steep (see FIG. 6D) by setting the resistance value of the gate resistor 742*a* in the adjustment circuit 742 at a slightly larger value (in the present example, Rg=4.7Ω) so that a slight amount of overdamping occurs as compared to the previously described optimum state (i.e. the state of critical damping in which no overshoot occurs while the decrease in steepness of the waveform in the rising and falling phases is sufficiently small). By adjusting this state of decrease in steepness of the waveform to the timing of the charging of the gate terminal of the MOSFET 741 triggered by the input of the dummy-pulse signal b', the gate voltage immediately before the generation of the high-voltage pulse can be almost consistently maintained regardless of the measurement period. As a result, the temporal discrepancy of the generation of the high-voltage pulse can be even more reduced.

That is to say, in the present embodiment, the gate voltage is given a predetermined transient characteristic as shown in FIG. 6D by determining the resistance value in the adjustment circuit 742 so as to create the state of overdamping which causes a decrease in steepness of the waveform to such an extent that the decrease in gate-terminal-charging voltage due to the natural electric discharge under the condition of tp>tgc can be cancelled while the gate voltage immediately before the generation of the high-voltage pulse can be almost consistently maintained regardless of the measurement period.

It should be noted that a gate capacitor may be added as needed to control the decrease in charging voltage due to the natural electric discharge so that the gate voltage immediately before the generation of the high-voltage pulse will be even more consistently maintained.

[Case 2] Shortest Ion Ejection Period Tp<Gate-Charging Period Tgc (FIGS. 7A-7D)

For example, this is the case where the shortest ion ejection period tp is 125 μs and the gate-charging period tgc is 150 μs. Since the shortest ion ejection period tp<the gate-charging period tgc, the longer the measurement period is, the shorter the period of time becomes from the point in time of the last charging of the gate terminal to the point in time of the generation of the high-voltage pulse, as shown in FIG. 7B. This leads to a smaller decrease in charging voltage due to the natural electric discharge. In order to cancel this, an overshoot is intentionally made to occur in the falling phase of the gate voltage (see FIG. 7D) by setting the resistance value of the gate resistor 742*a* in the adjustment circuit 742 at a slightly smaller value (in the present example, Rg=2.7Ω) to create the state of slightly insufficient damping as compared to the previously described optimum state. By making such a state of overshooting coincide with the timing of the charging of the gate terminal of the MOSFET 741 triggered by the input of the dummy-pulse signal b', the gate voltage immediately before the generation of the high-voltage pulse can be almost consistently maintained regardless of the measurement period. Therefore, the temporal discrepancy of the generation of the high-voltage pulse can be even more reduced.

That is to say, in the present embodiment, the gate voltage is given a predetermined transient response as shown in FIG. 7D by determining the resistance value in the adjustment circuit 742 so as to create the state of insufficient damping which causes an overshoot to such an extent that the decrease in gate-terminal-charging voltage due to the natural electric discharge under the condition of tp<tgc can be cancelled while the gate voltage immediately before the generation of the high-voltage pulse can be almost consistently maintained regardless of the measurement period.

As with the previously described case, a gate capacitor may be added as needed to control the decrease in charging voltage due to the natural electric discharge so that the gate voltage immediately before the generation of the high-voltage pulse will be even more consistently maintained.

Figure 8A:
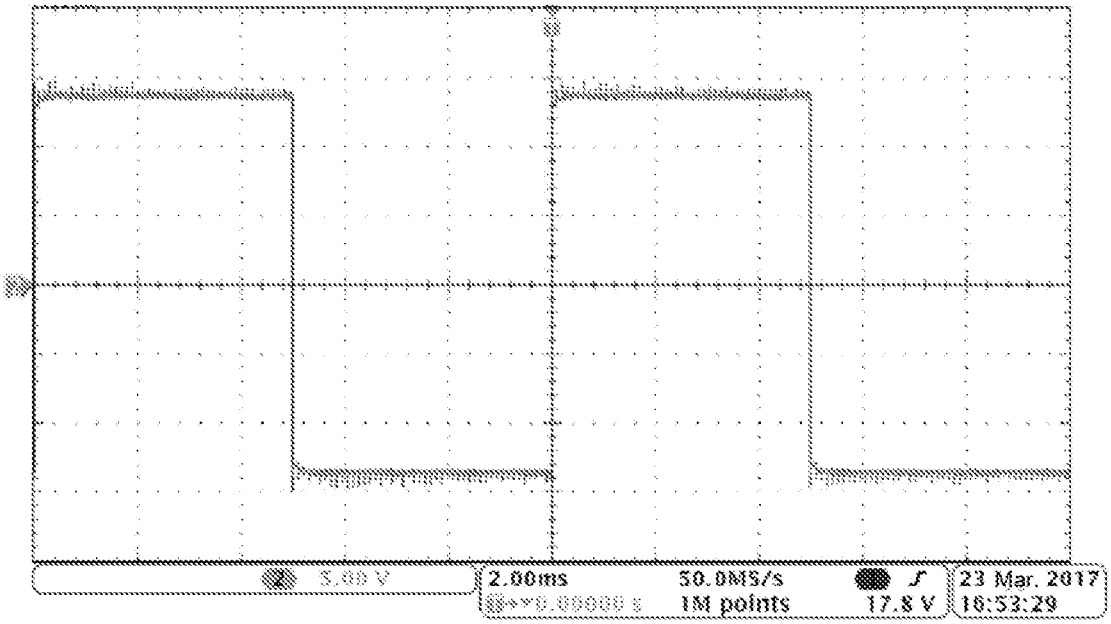
FIGS. 8A and 8B are graphs showing measured waveforms of the gate voltage in the case of FIGS. 6A-6D (with a gate resistor of 4.7Ω and gate capacitor of 1000 pF).
Figure 8B:
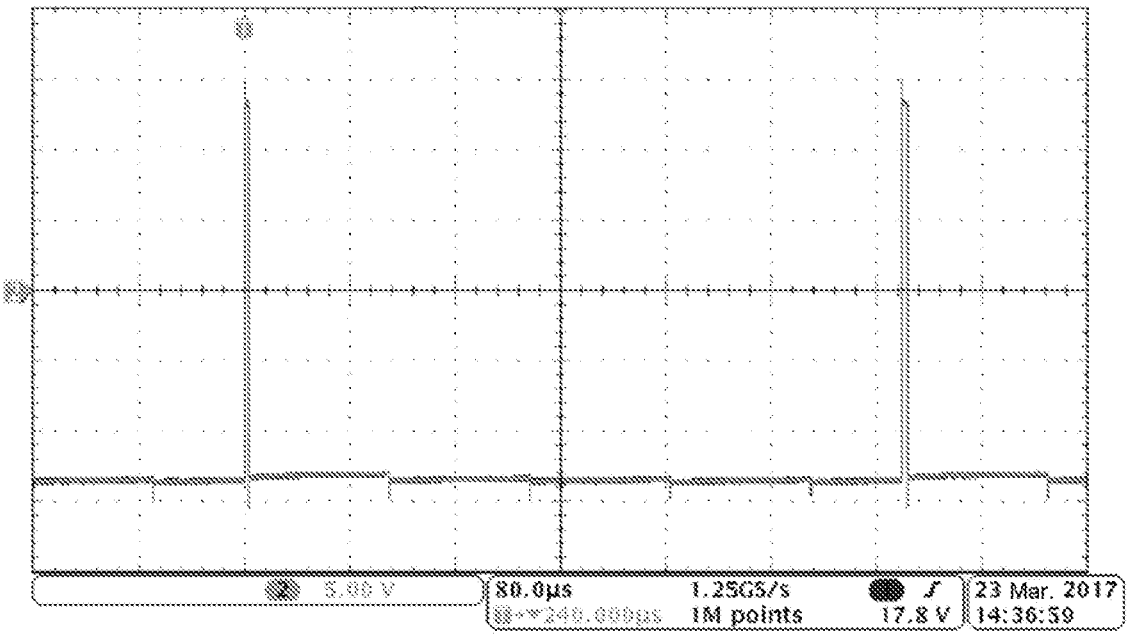
Figure 9:
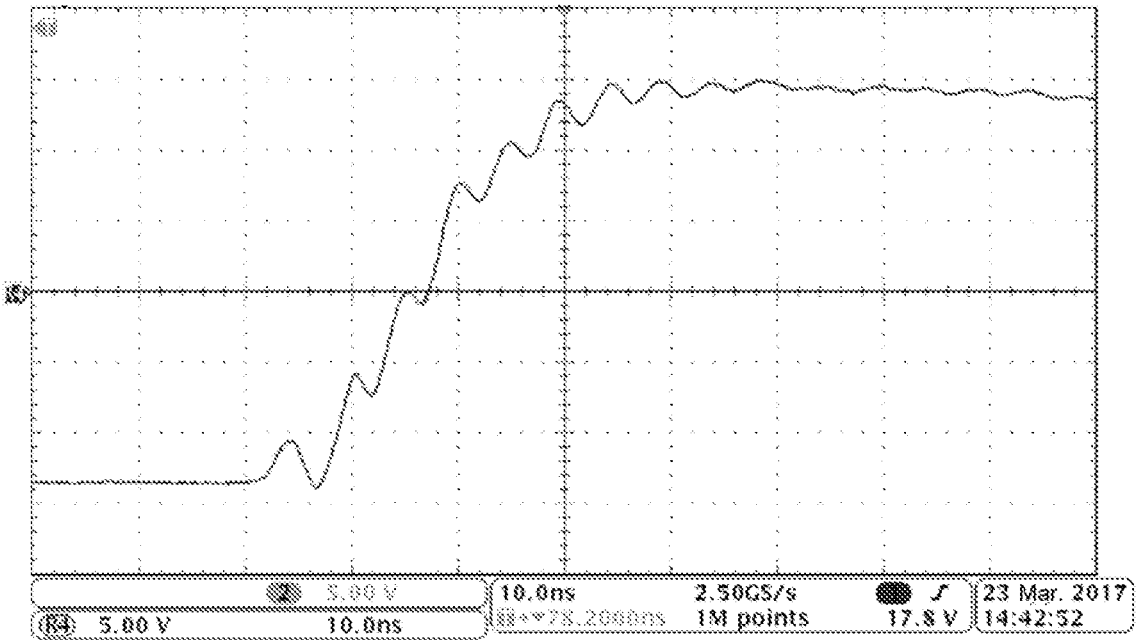
FIG. 9 is a graph showing a measured waveform of the gate voltage in a switching operation from a negative voltage to a positive voltage, with the measurement period set at 125 μs and 500 μs.

FIGS. 8A and 8B are graphs showing measured waveforms of the gate voltage in Case 1. The resistance value Rg of the gate resistor 742*a* is 4.7Ω. The capacitance value of the gate capacitor 742*b* is 1000 pF. FIG. 9 is a graph showing a measured waveform of the gate voltage in the switching operation from a negative voltage to a positive voltage, with the measurement period set at 125 μs and 500 μs. In the present case, the gate terminal of the MOSFET 741 is charged from ~13.5V to a predetermined positive voltage regardless of whether the measurement period is 125 μs or 500 μs. That is to say, the voltage at the point in time where the gate voltage begins to rise is consistently maintained regardless of the measurement period.

Figure 10:
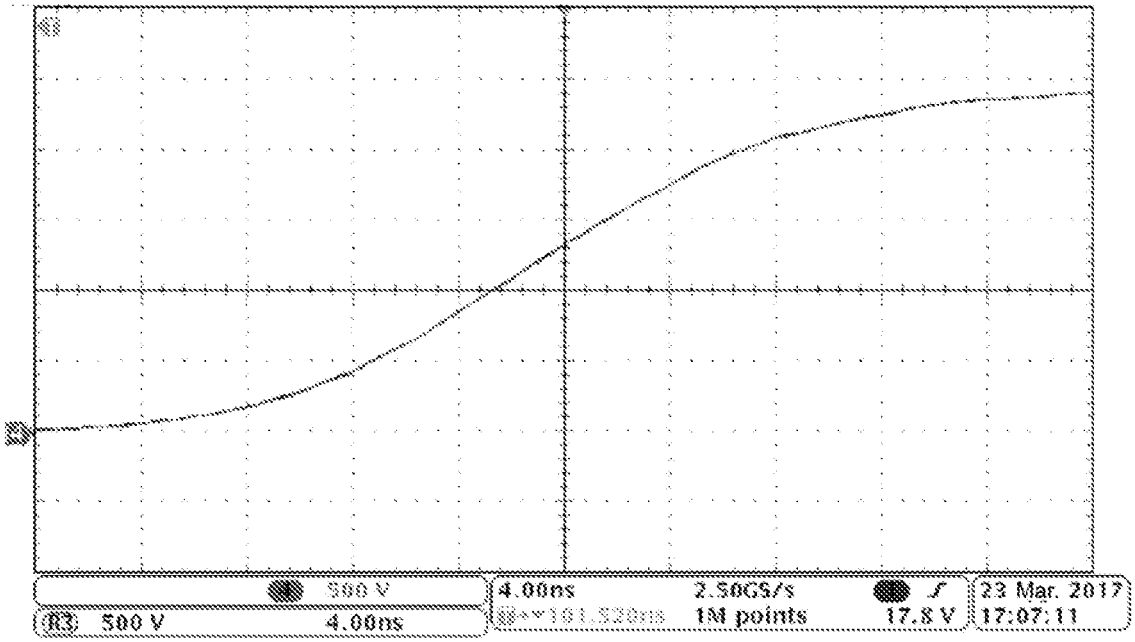
FIG. 10 is a graph showing a measured waveform of the output voltage in the case of FIG. 9.
Figure 11:
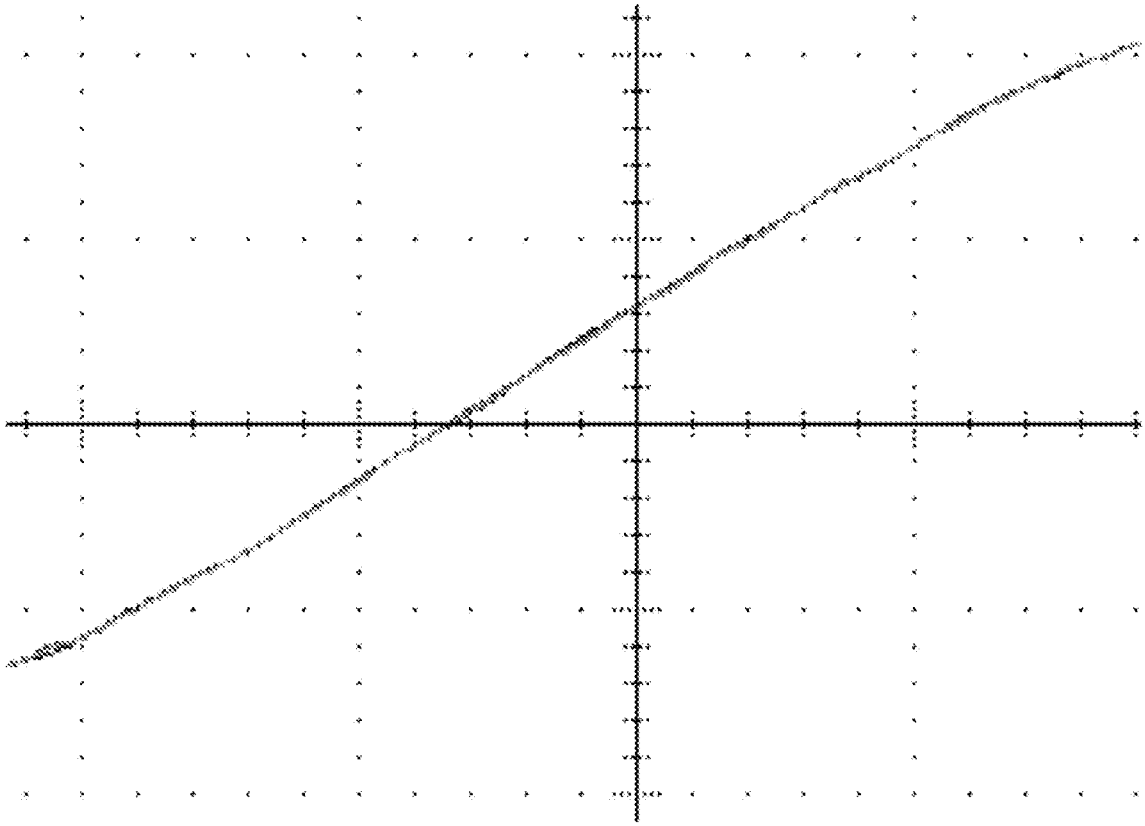
FIG. 11 is a partially enlarged view of the waveform of the output voltage shown in FIG. 10.

FIG. 10 is a graph showing a measured waveform of the output voltage. FIG. 11 is a partially enlarged view of the waveform of the output voltage shown in FIG. 10. The temporal discrepancy between the case with the measurement period of 125 μs and the case with the measurement period of 500 μs is barely recognizable on the graph shown in FIG. 11. This demonstrates that the temporal discrepancy has been almost eliminated.

The descriptions thus far have been concerned with the case where the measurement-target ion is a positive ion. In the case where the measurement-target ion is a negative ion, the ion is ejected by applying a high-voltage pulse having a pulse peak value −V (e.g. −2500V) to the push-out electrode 11. It is evident that such a high-voltage pulse can be generated in the acceleration voltage generator 7 by setting +V=0 and −V=−2500V as well as appropriately changing the timing of the pulse signals a and b.

It should be noted that the previously described embodiment is a mere example of the present invention, and any change, addition or modification appropriately made within the spirit of the present invention will naturally fall within the scope of claims of the present application.

For example, as opposed to the previously described embodiment in which the present invention is applied in an OA-TOFMS, the present invention may also be applied in other types of TOFMS, such as an ion trap time-of-flight mass spectrometer in which ions held within a three-dimensional quadrupole type or linear type of ion trap are accelerated and sent into a flight space, or a time-of-flight mass spectrometer in which ions generated from a sample by a MALDI ion source or similar device are accelerated and sent into a flight space.

REFERENCE SIGNS LIST

1 . . . Ion Ejector
11 . . . Push-Out Electrode
12 . . . Extraction Electrode
2 . . . Flight Space
3 . . . Reflector
31 . . . Reflection Electrode
32 . . . Back Plate
4 . . . Detector
5 . . . Data Processor
6 . . . Controller
7 . . . Acceleration Voltage Generator
71 . . . Primary-Side Driver Section
711, 712, 715-718, 731, 732, 741 . . . MOSFET
713, 72 . . . Transformer
72*a* . . . Primary Winding
72*b* . . . Secondary Winding
73 . . . Secondary-Side Driver Section
730 . . . Transformer Load Resistor
733 . . . Gate Discharge Resistor
74 . . . Switch Circuit
742 . . . Adjustment Circuit
742*a* . . . Gate Resistor
742*b* . . . Gate Capacitor
75 . . . High-Voltage Power Source
76 . . . Primary-Side Power Source
771 . . . Plus-Side Pulse Signal Input End
772 . . . Minus-Side Pulse Signal Input End
79 . . . Voltage-Output End
8 . . . Reflection Voltage Generator

The invention claimed is:

1. A time-of-flight mass spectrometer including an ion ejector configured to eject a measurement-target ion into a flight space by imparting acceleration energy by an effect of an electric field created by a voltage applied to an electrode, and a high-voltage pulse generator configured to apply a high-voltage pulse for ion ejection to the electrode, wherein:

the high-voltage pulse generator includes:

a) a DC power source configured to generate a high DC voltage;

b) a switch circuit configured to generate the high-voltage pulse by switching the high DC voltage generated by the DC power source, and to output the high-voltage pulse to a voltage-output end, the switch circuit including one or more plus-side switching elements and one or more minus-side switching elements connected in series, where each of the plus-side switching elements is configured to output a plus-side voltage generated by the DC power source to the voltage-output end when in an ON state, and each of the minus-side switching elements is configured to output a minus-side voltage generated by the DC power source to the voltage-output end when in an ON state;

c) a switching element driver configured to turn on/off the switching elements according to a pulse signal for ejecting ions, the switching element driver including a first switching element driver configured to respond to a first pulse signal and electrically charge a control terminal to a voltage which turns on the plus-side switching element or a voltage which maintains the plus-side switching element in the ON state, as well as a second switching element driver configured to respond to a second pulse signal and electrically charge the control terminal to a voltage which turns on the minus-side switching element or a voltage which maintains the minus-side switching element in the ON state;

d) an adjustment circuit including a resistor inserted in series with the control terminal on a signal path extending from the switching element driver to the control terminal, the adjustment circuit configured to make the voltage at the control terminal be a voltage having a predetermined transient characteristic; and e) a controller configured to generate the first pulse signal and the second pulse signal in addition to the pulse signal for starting the output of the high-voltage pulse, so as to recharge the control terminal of the plus-side switching element or the minus-side switching element which is in the ON state.

2. The time-of-flight mass spectrometer according to claim 1, wherein:

the time-of-flight mass spectrometer is a device configured to repeatedly perform, with a predetermined measurement period, a measurement in which ions are ejected from the ion ejector and detected after being made to fly in a flight space, and in which the measurement period is variable.

3. The time-of-flight mass spectrometer according to claim 2, wherein:

a resistance value of the resistor in the adjustment circuit is determined so as to substantially satisfy critical damping conditions.

4. The time-of-flight mass spectrometer according to claim 2, wherein:

the controller is configured to generate the second pulse signal for recharging and thereby recharge the control terminal of the minus-side switching element a specific length of time earlier than the point in time of the generation of the pulse signal for starting the output of the high-voltage pulse, when starting the output of the high-voltage pulse of the plus-side voltage, as well as generate the first pulse signal for recharging and thereby recharge the control terminal of the plus-side switching element a specific length of time earlier than the point in time of the generation of the pulse signal for starting the output of the high-voltage pulse, when starting the output of the high-voltage pulse of the minus-side voltage.

5. The time-of-flight mass spectrometer according to claim 2, wherein:

a plurality of measurement periods are set to be substantially equal to integer multiples of a shortest ion ejection period, and a resistance value of the resistor in the adjustment circuit is determined according to the shortest ion ejection period and a control-terminal-recharging period with which the controller repeatedly sends the pulse signal for recharging.

6. The time-of-flight mass spectrometer according to claim 5, wherein:

the control-terminal-recharging period is shorter than the shortest ion ejection period, and the resistance value of the resistor in the adjustment circuit is determined so that a state of overdamping occurs.

7. The time-of-flight mass spectrometer according to claim 5, wherein:

the control-terminal-recharging period is longer than the shortest ion ejection period, and the resistance value of the resistor in the adjustment circuit is determined so that a state of insufficient damping occurs.

* * * * *